United States Patent [19]

Dragoun

[11] 3,990,285

[45] Nov. 9, 1976

[54] METHOD OF AND APPARATUS FOR SHAPING ARTICLES BY ROLLING

[75] Inventor: Jozef Dragoun, Nove Mesto nad Vahom, Czechoslovakia

[73] Assignee: Vyskumny ustav mechanizacie a automatizacie, Nove Mesto nad Vahom, Czechoslovakia

[22] Filed: Dec. 5, 1974

[21] Appl. No.: 529,718

[52] U.S. Cl. ..... 72/67; 72/406; 72/429

[51] Int. Cl.[2] ..... B21J 13/02

[58] Field of Search ..... 72/406, 429, 67, 112, 72/115, 122, 124, 126

[56] References Cited

UNITED STATES PATENTS

| | | | |
|---|---|---|---|
| 3,440,850 | 4/1969 | Friedrich | 72/67 |
| 3,494,161 | 2/1970 | Silichev | 72/115 |
| 3,523,442 | 8/1970 | Marciniak | 72/406 |
| 3,620,060 | 11/1971 | Ramseier | 72/112 |
| 3,653,243 | 4/1972 | Ramseier | 72/126 |
| 3,703,823 | 11/1972 | Wilson | 72/406 |
| 3,768,289 | 10/1973 | Mink | 72/67 |

*Primary Examiner*—C.W. Lanham
*Assistant Examiner*—Gene P. Crosby

[57] ABSTRACT

Different surfaces of articles are shaped by means of a shaping tool. The active surface of the shaping tool is rolled reversibly along the shaped surface with a point contact in the axial plane of the shaped surface, such axial plane turning around the axis of the shaped surface, the amplitude of this reversible relative rolling being selected arbitrarily.

8 Claims, 13 Drawing Figures

METHOD OF AND APPARATUS FOR SHAPING ARTICLES BY ROLLING

BACKGROUND OF THE INVENTION

The invention relates to a method of and apparatus for shaping articles by the relative rolling of an active surface of a shaping tool along a shaped surface.

The most advanced methods of shaping rivet heads are based on a hypocycloidical movement of the rivet snap or die, in the course of which movement a progressive radial shifting of the material from the center of the shaped surface toward its circumference takes place. The most recent modifications of arrangements based on this principle use a superposition of two rotating motions, and also possibly of a rotating and a straight line motion, thereby extending the possibility of selection of the course of the relative rolling. Similar arrangements are also used for forging, in which one of the dies performs this motion. A common feature of all these methods is that the tool or its holder is supported by a spherical surface, the center of which is at the same time the center of the formed surface. In these cases the center of the shaping tool is in constant contact with the center of the shaped surface, and the remaining points of the active surface of the shaping tool subsequently join in the relative rolling operation. A drawback of apparatus operating with a hypocycloidical relative rolling is that the cycloids of the relative rolling follow each other in the direction of the circumference of the shaped surface, thereby generating lateral forces which act on the shaped surface. Such lateral forces may in some cases by undesirable. With known arrangements it is impossible to alter the diameter of shaping or the amplitude of the deviation within the shaping interval operations which are desirable in some cases of shaping. A drawback of known arrangements is also that important operating points which are exposed to shaping forces have to be provided with sliding frictional supports.

SUMMARY OF THE INVENTION

It is an object of this invention to provide a process for shaping of pieces by relative rolling wherein a point contact of the shaping tool with the shaped surface is maintained within the whole shaping operation. It is another object of this invention to eliminate any lateral forces which last longer than one half cycle of the relative rolling.

A further object is to make it possible to change the actual diameter of shaping according to any arbitrary course within the whole shaping operation. A still further object is to provide a rolling support for important operating points exposed to shaping forces.

According to this invention, the shaping tool rolls relatively with its active surface acting reversibly with a point contact in the axial plane of the shaped surface. The axial plane turns around the axis of the shaped surface, whereby the magnitude of the amplitude of the reversible relative rolling motion can be changed arbitrarily within the shaping operation according to a selected procedure. The magnitude of the amplitude of the reversible relative rolling motion can be continuously changed within the rolling operation from zero to a maximum value and vice versa, or the magnitude of this amplitude can remain constant within the whole shaping operation.

The apparatus for carrying out this process is supported between an upper supporting disc and a lower supporting disc. The lower surface of the upper supporting disc is provided with means providing for the sliding guiding of the upper slide. The upper slide on its lower part has a guiding element engaging with an upper eccentric groove of a disc for reversible relative rolling. The upper surface of the lower supporting disc is provided with means providing for the sliding guiding of the lower slide. The lower slide in its upper part is provided with a guiding element which engages a lower eccentric groove of the disc for reversible relative rolling. A bar for reversible relative rolling is provided with an opening in the plane of the upper slide, supporting an upper sliding block in this opening, and being connected by means of an upper bolt with the upper slide. A lower sliding block, connected by means of a lower bolt with the lower slide, is supported in an opening of the bar for reversible relative rolling in the plane of the lower slide. The bar for reversible rolling is supported by means of a roller by a rolling track formed in a support which is fixed to the upper supporting disc.

According to another alternative, the disc for reversible relative rolling is divided into an upper disc for reversible relative rolling and a lower disc for reversible relative rolling, with a disc for changing the amplitude inserted between them. There is furthermore a rear shaft with an upper driving wheel fixed thereto opposite to the upper disc for reversible relative rolling, a lower driving wheel being fixed to the rear shaft opposite to the lower disc for reversible relative rolling, the transmission ratios of both these driving discs being equal. A central driving wheel is fixed to the rear shaft opposite to the disc for changing the amplitude, the central driving wheel having a different transmission ratio from the earlier mentioned driving discs.

The disc for changing the amplitude is provided with an upper eccentric groove and with a lower eccentric groove. An upper intermediate piece is inserted between the upper slide and the upper discs for reversible relative rolling. The upper surface of the upper intermediate piece is provided with a groove into which a guiding element of the upper slide engages. The lower part of the upper intermediate piece is guided in a sliding guiding on the upper disc for reversible relative rolling. The lower surface of the upper intermediate piece is provided with an upper guiding element which engages into the upper eccentric groove of the discs for changing the amplitude. A lower intermediate piece is inserted between the lower slide and the lower disc for reversible relative rolling. The lower surface of the lower intermediate piece is provided with a groove into which a guiding element of the lower slide is engaging. The upper part of the lower intermediate piece is slidingly guided in the lower sliding guiding on the lower disc for reversible relative rolling. The upper surface of the lower intermediate piece is provided with a lower guiding element engaging into the lower eccentric groove of the disc for changing the amplitude.

An independent driving mechanism with an arbitrary adjustable transmission ratio can be arranged opposite to the disc for changing the amplitude.

According to another alternative, the drive is transmitted from a single driving shaft, and above the upper slide a two sided upper supporting disc is rotatably supported, its upper side of such upper disc being provided with a means for the sliding guiding of an auxiliary slide, the lower side of such upper disc being provided with a lower sliding guiding means. The auxiliary slide is connected by connecting elements with the upper slide. The upper slide is slidingly supported in the lower sliding guiding means. The two sided upper supporting disc in its upper part is connected firmly with the supporting disc. A supporting bolt is fixed in the longitudinal axis of this supporting disc, the bolt rotatably supporting two roller clutches disposed one above the other and operating in opposite directions. The roller clutches have a toothed rim on their external circumferences. The toothed rims mesh with toothed brackets fixed on the auxiliary slide.

The holder for the shaping tool can be rotatably supported on the bar for reversible relative rolling.

The holder of the shaping tool can be also supported by an elastic element, and the shaping tool can be secured in the holder against rotation and shifting.

Shaping by reversible relative point rolling in the axial plane of the shaped surface has the advantage of a point contact between the shaping tool and the shaped surface within the whole shaping operation. Another advantage of this process is that no lateral forces are generated in the course of the reversible relative rolling which last longer than half a cycle of the relative rolling, whereby the instantaneous diameter of shaping can be changed according to any arbitrary plan within the whole shaping operation. Thus there can be an intensive displacement of the shaped material from the center of the shaped surface to its circumference, which is desirable for the major part of shaping operations. An advantage of this new process is also that it permits a rolling support of important points of an article exposed to shaping pressure.

DESCRIPTION OF THE DRAWINGS

The attached drawings show schematically different courses of relative point rolling of the active surface along the shaped surface and four examplary embodiments of the respective arrangement.

In the drawings.

DESCRIPTION OF PREFERRED EMBODIMENTS

Figure 1:
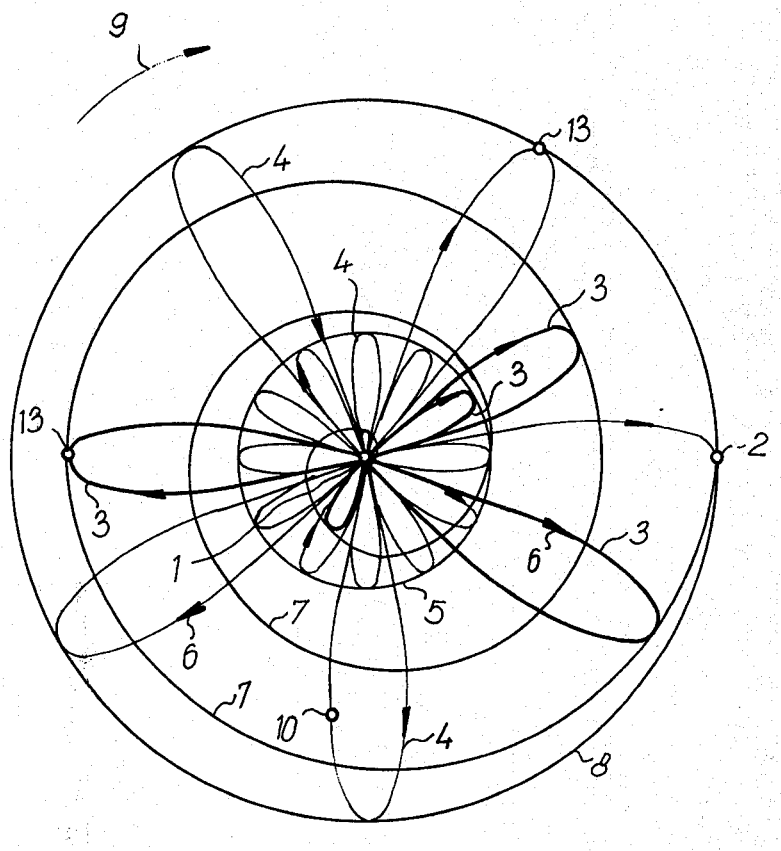
FIG. 1 shows a projection of the curve for reversible relative point rolling with a common course of change of the magnitude of the amplitude of the reversible relative rolling.
Figure 7:
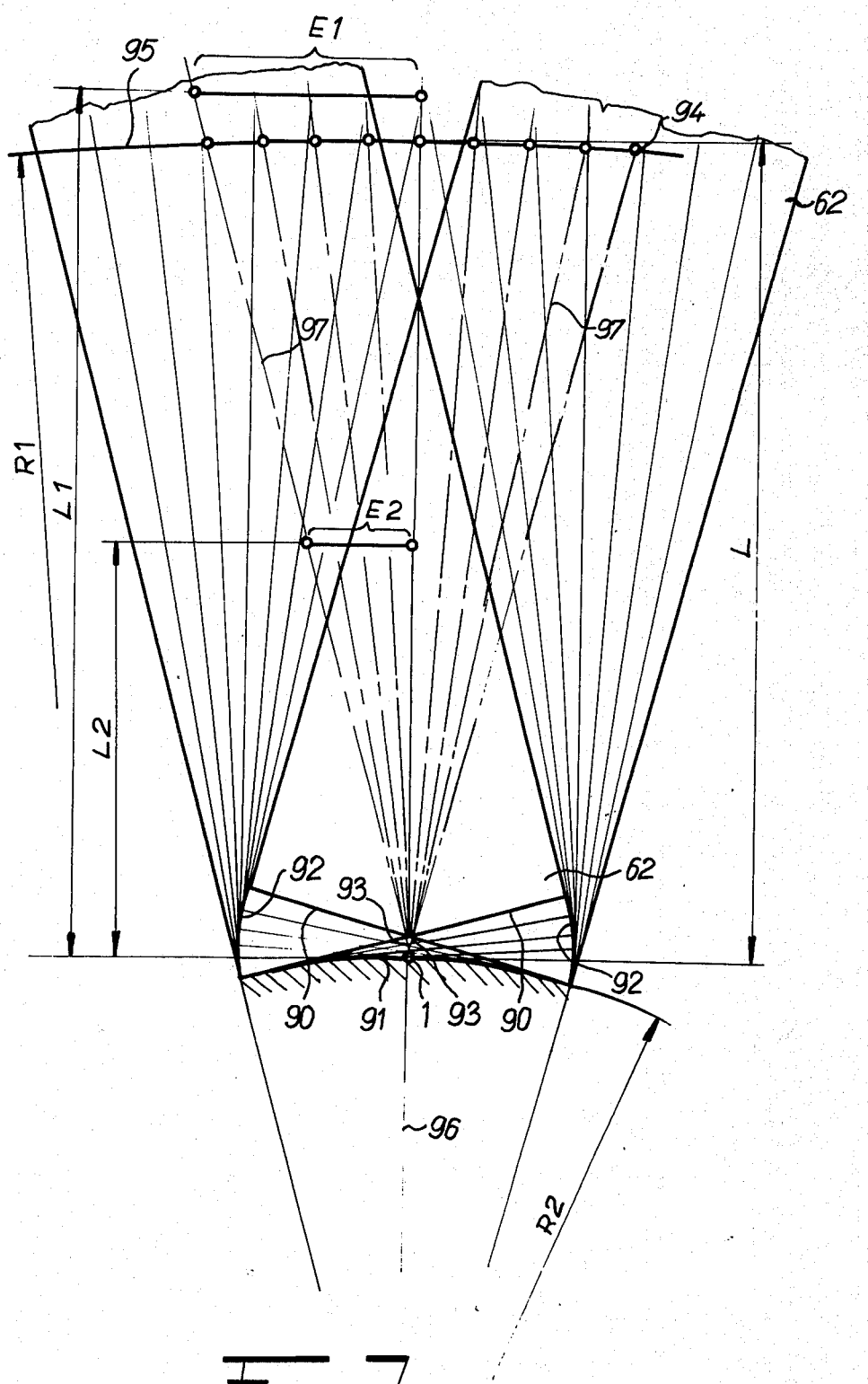
FIG. 7 is a projection of the reversible relative rolling movement with a constant amplitude to the axial plane of the shaped surface.

The projection of the shaped surface 91 (see FIGS. 7 and 8) and the locus of common points 10 of relative rolling or of the curve of reversible relative rolling into a plane perpendicular to the axis 96 of the shaped surface (FIGS. 7 and 8) is shown in FIG. 1. The distance from the center 1 of the shaped surface to the turning point 13 of relative rolling represents the amplitude of the reversible relative rolling. In case of a constant amplitude, its magnitude is at the same time the radius of the shaped surface; in the case of a variable magnitude of the amplitude, its magnitude is also the instantaneous radius of shaping. The curve 3 of relative rolling in the phase of change of the amplitude is shown in FIG. 1 by a full line. Its turning points 13 of relative rolling are on a curve 7 showing the increase of the amplitude. A curve 4 for relative rolling in a phase of a constant amplitude is shown in FIG. 1 by a thin line, whereby the constant amplitude is indicated by a circle 5 of a constant amplitude, or by a circle 8 of the diameter of the shaped surface; the turning points 13 of these curves are situated on these circles. The direction 9 of rotation indicates the direction of turning of the plane of the reversible relative rolling, and the direction 6 of the rolling motion illustrates how this motion proceeds in the rotating plane of reversible relative rolling.

The described curve 3 of relative rolling in the phase of change of the amplitude and the curve 4 in the phase of a constant amplitude illustrate the method of shaping of pieces, for instance of closing the heads of (heading) rivets by reversible relative rolling of the active surface 90 of the shaping tool 62 in a rotating axial plane of the shaped surface 91. This plane turns around the axis 96 of the shaped surface (see FIGS. 7 and 8) in which this plane lies. The magnitude of the amplitude of the reversible relative rolling can thereby be arbitrarily changed, according to a chosen course.

FIG. 1 shows a course which starts with a continuous increase of the magnitude of the amplitude, which is represented by the curve 3 of the relative rolling in the phase of change of the amplitude, continues by a rversible relative rolling with constant magnitude of the amplitude, represented by the curve 4 of relative rolling in the phase of a constant amplitude and by the circle 5 of a constant amplitude. The course of the change of the magnitude continues again by an increase of the amplitude up to its maximum magnitude represented by the circle 8 of the diameter of the shaped surface. At this magnitude a relative rolling with constant amplitude starts again. The whole course of reversible relative rolling starts at the center 1 of the shaped surface and ends at the end point 2.

Figure 2:
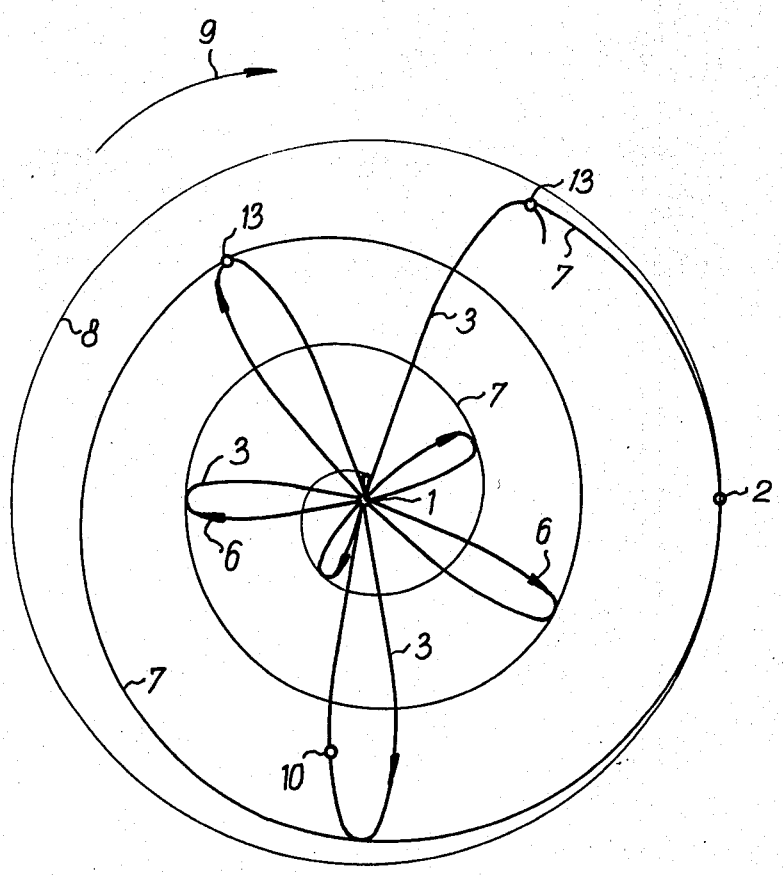
FIG. 2 is a projection of the curve for reversible relative rolling with a continuous course of change of the magnitude of the amplitude of reversible relative rolling.

In case the magnitude of the amplitude of the reversible relative rolling changes continuously from zero to maximum within the whole shaping interval, the projection of the curve 3 of the relative rolling in the phase of increase of the amplitude into a plane perpendicular to the axis 96 of the shaped surface has the shape shown in FIG. 2. The center 1 of the shaped surface and the end point 2 represents the interval of increase of the amplitude indicated by the curve 7 of increase of the amplitude. The turning points 13 of relative rolling lie on this curve. The curve 3 of relative rolling in the phase of increase of the amplitude which starts at the center 1 of the shaped surface and which ends at the end point 2 on a circle 8 with the diameter of shaping, is the locus of common points 10 of relative rolling. The direction 6 of rolling and the direction 9 of rotation indicate the subsequent relative rolling and the turning of the plane of reversible relative rolling.

According to this invention, the active surface 90 (FIG. 7) of the shaping tool 62 performs a relative rolling motion point by point along the shaped surface 91 (FIG. 7) in the axial plane of the shaped surface 91, which turns around the axis 96 of the shaped surface, which is in the axial plane of the reversible relative rolling. The magnitude of the amplitude of the reversible relative rolling thereby changes from zero to a maximum. If the shaping process is not finished within the described interval, the relative rolling proceeds at a continuous reduction of the magnitude of the amplitude from maximum to zero and this reversible process can be repeated. The number of cycles of reversible relative rolling for one interval of change of the magnitude of the amplitude depends on the transmission ratios of the driving means of the movement of the reversible relative rolling, which causes the change of the magnitude of the amplitude and the turning of the plane of the reversible relative rolling.

Figure 3:
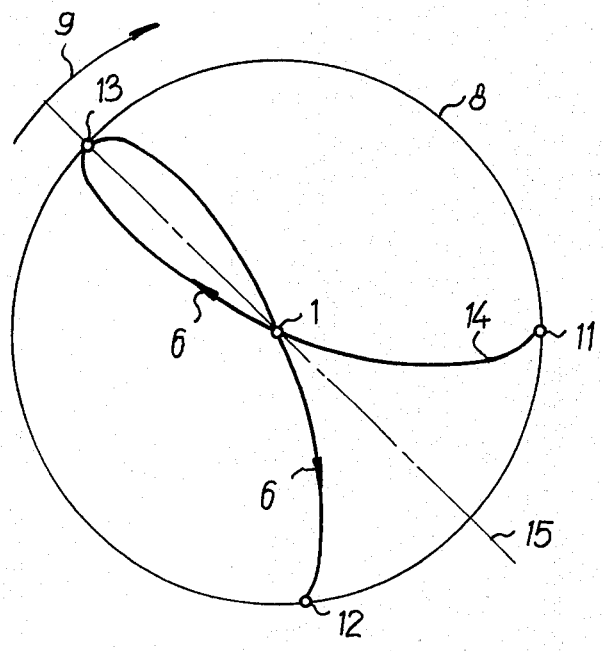
FIG. 3 is a curve for reversible relative rolling with a constant amplitude.

A curve 14 of a relative rolling with a constant amplitude is shown in FIG. 3 as one cycle of reversible relative rolling. The start 11 of the relative rolling, the turning point 13 thereof, and the end 12 of the relative rolling determine this cycle and divide it into two half cycles, separated by the axis of symmetry 15, passing through the turning point 13 of relative rolling and through the center 1 of the shaped surface. The start 11 of relative rolling, the turning point 13 thereof and the end 12 of relative rolling lie on a circle 8 with the diameter of the shaped surface. The direction 6 of relative rolling and the direction 9 of rotation illustrate the sequence of the reversible relative rolling in the rotating plane. In this case it is not material whether we start from the center 1 of the shaped surface or from any other place, since one cycle of relative rolling is so short that the advantage of shaping from the center 1 of the shaped surface is not substantial.

Figure 4:
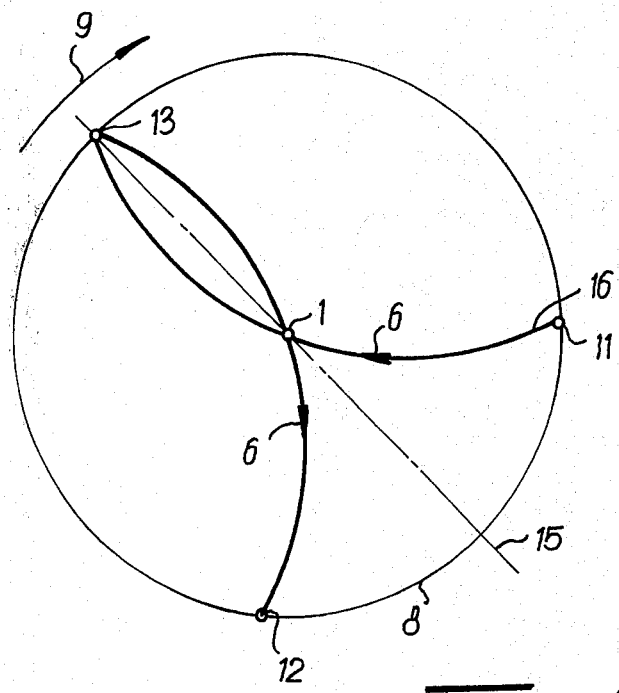
FIG. 4 is a curve of reversible relative rolling with a constant amplitude in case the turning of the plane of the reversible relative rolling is derived from the movement of the reversible relative rolling.

A curve 16 of relative rolling with a constant amplitude and a dependent turning of the plane of relative turning shown in FIG. 4 differs from the just shown curve 14 for relative rolling with a constant amplitude in that the turning of the plane of reversible relative rolling is derived from the movement of the reversible relative rolling and the turning point 13 of relative rolling is a place of zero speed of the reversible relative rolling and of zero speed of the rotation of the plane of relative rolling, the consequence thereof being the shape of this curve.

Figure 5:
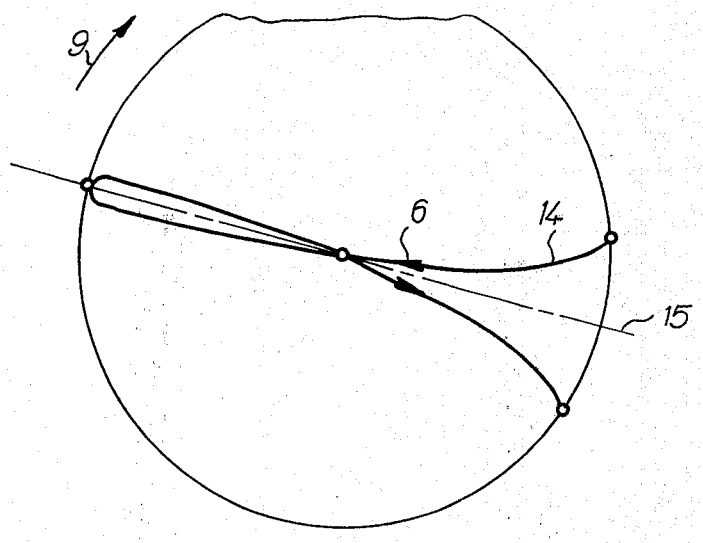
FIG. 5 is a curve for reversible relative rolling with a constant amplitude with a distinctly prevailing radial component of the movement.
Figure 6:
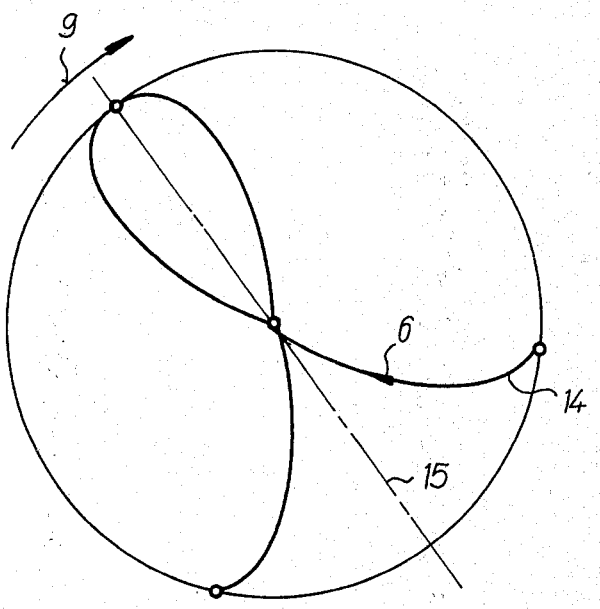
FIG. 6 is a curve for reversible relative rolling with a constant amplitude with a not distinctly prevailing radial component of the movement with respect to the tangential component.

The shape of the curve for relative rolling can be influenced by selection of the mutual transmission ratio between the reversible relative rolling motion and the turning of the plane of the reversible relative rolling. Thus it is possible to influence the ratio of the tangential and radial component of the curve for relative rolling and therefore also the ratio of the tangential and radial component of deformation, which is of importance for differenet operations of shaping and for different kinds of material. FIG. 5 shows a curve 14 for relative rolling with a distinct part of the radial component of the curve for reversible relative rolling. FIG. 6 shows a curve 14 for relative rolling with constant amplitude and with a less distinct part of the radial component of the reversible relative rolling.

The shaped surface 91 (FIG. 7) has the shape of a part of a spherical surface, showing in a projection of the meridional plane as a circle with a radius R2. The shaping tool 62 with a planar active surface 90 is shown in several positions of the reversible relative rolling. The track 95 of the operating point is the locus of positions of the operating point 94 in the axis 97 of the tool, at a distance L from the plane of the active surface 90. In the case shown in FIG. 7, the track 95 of the operating point 94 has the shape of a circular arc of a radius R1. In the course of relative rolling of the active surface 90 along the shaped surface 91 its extreme points circumscribe circumferential involutes 92 and its center circumscribes central involutes 93. The axis 96 of the shaped surface is the axis of reversible relative rolling. The upper eccentricity E1 of the axis 97 of the tool at a distance L1 of the upper eccentricity from the plane of the active surface 90 and the lower eccentricity E2 of the axis 97 of the tool at the distance L2 of the lower eccentricity correspond to the maximum amplitude of the reversible relative rolling.

A condition for relative rolling of the active surface 90 along the shaped surface 91 is the movement of the operating point 94 in the axis 97 of the tool along the track 95 of the operating point and the maintenance of the upper eccentricity E1 and of the lower eccentricity E2. The maintenance of the eccentricity in one plane and of the movement of the operating point 94 in the axis 97 of the tool is sufficient for determining the relative rolling; it is, however, advisable for the respective constructional solution to select the coupling to the eccentricity in two planes. The shape of the shaped surface 91 can be changed by selection of the shape of the active surface 90. A spherical shape of the shaped surface is obtained both in case of a planar shape of the active surface 90 and in case of a concave spherical shape of the active surface 90. A planar shape of the shaped surface 91 is obtained in case of a convex spherical shape of the active surface 90. Other shapes of the shaped surfaces 91 can be obtained by suitable adjustments of the active surface 90.

Figure 8:
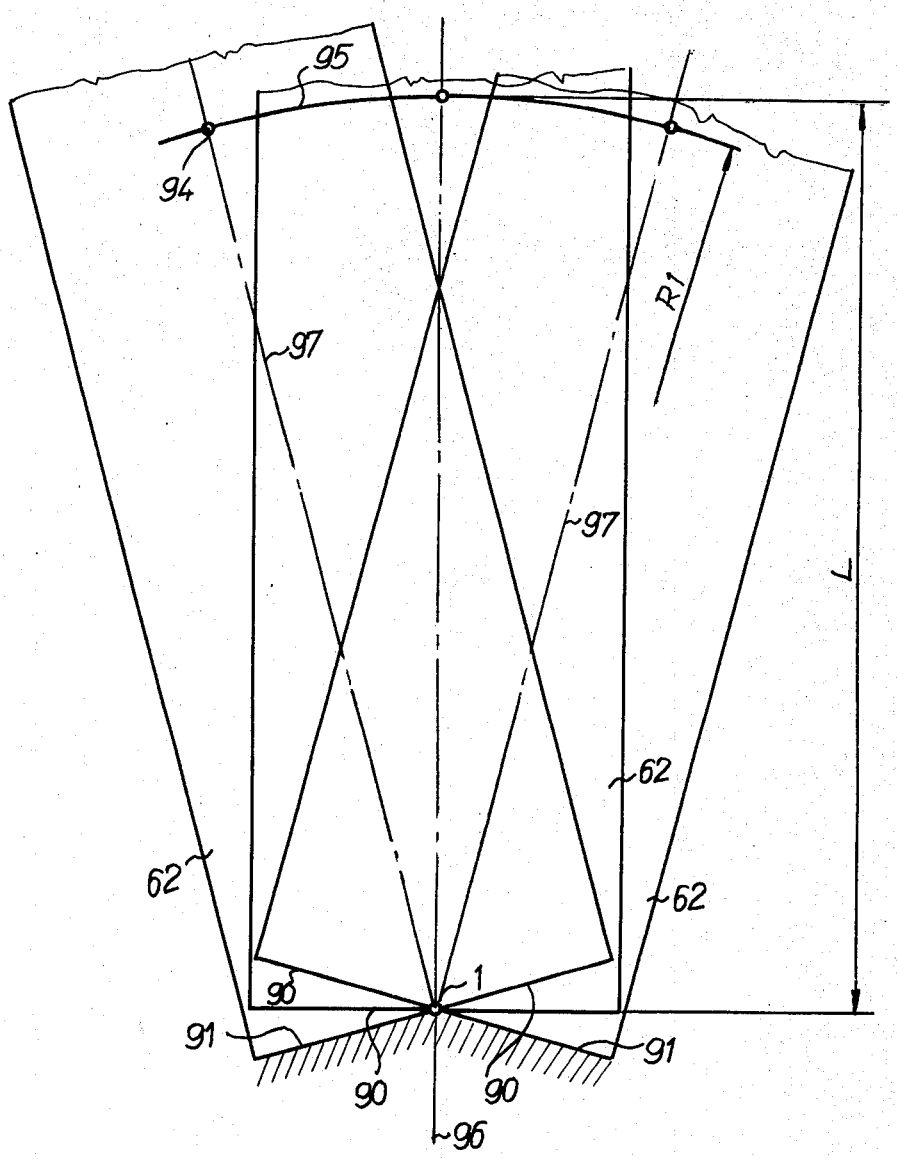
FIG. 8 is a projection of the reversible relative rolling movement with a constant amplitude to the axial plane of the shaped surface in a limit case of relative rolling.

FIG. 8 shows a projection of a reversible relative rolling with constant amplitude for limit conditions determined by equal values of the radius of the operating point. In this case, the center of curvature of the track 95 of the operating point is the center 1 of the shaped surface. In a limit case, the result of relative rolling of the active surface 90 would be a conical shape of the shaped surface 91. From this it follows that the radius R1 of the track of the operating point must be larger than the distance L of the operating point; as in the case of equality of the radius R1 of the track of the operating point and of the distance L of the operating point, no exact reversible relative point rolling would result, as is shown in FIG. 8. If the radius R1 of the track of the operating point is smaller than the distance L of the operating point, no relative rolling would occur.

Figure 9:
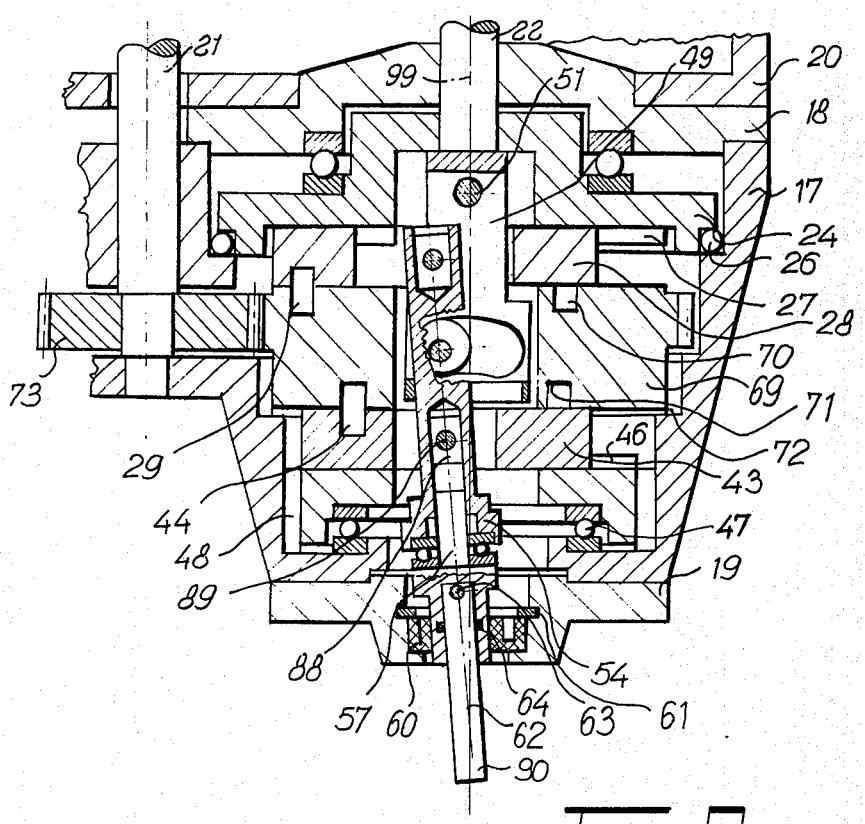
FIG. 9 shows a practical embodiment for shaping by reversible relative point rolling in a rotating axial plane of the shaped surface with a constant amplitude of the reversible relative rolling.

An arrangement carrying out the process according to this invention in an alternative with a constant amplitude of the reversible relative rolling is shown in FIG. 9 as a unit for shaping rivet heads. Within a body 17 of this unit with its axis 99 a lower supporting disc 45 is supported by a lower axial bearing 47 and by a lower radial bearing 48. An upper supporting disc 24 is rotatably supported in the upper part of the body 17 of the unit in a combined bearing 26 of the upper supporting disc and in an upper axial bearing 25 in the upper cover 18. The lower surface of the upper supporting disc 24 is provided with a sliding guiding 27 for the upper slide 28. The upper slide 28 is provided on its lower side with a guiding element 29 engaging in sliding fashion into an upper eccentric groove 70 of a disc 69 for reversible relative rolling.

Similarly, the lower supporting disc 45 is provided on its upper surface with a sliding guiding 46 for the lower slide 43. The lower slide 43 is provided on its upper side with a guiding element 44 engaging in sliding fashion into a lower eccentric groove 71 of the discs 69 for reversible relative rolling. The discs 69 for reversible relative rolling is rotatably supported in the body 17 of the unit by means of its bearing 72. A wheel 73 fixed on a rear shaft 21 meshes with the disc 69 for reversible relative rolling. The rear shaft 21 is rotatably supported in the body 17 of the unit. A central shaft 22 is fixed to the upper supporting disc 24 and a supporting piece 49 is fixed thereto by a bolt 51. The supporting piece 49 is provided with rolling tracks 50 for rollers 52. These rollers 52 are rotatably supported on bolts 53 on a bar 54 for reversible relative rolling. The bar 54 for reversible relative rolling in the plane of the upper slide 28 is connected with the upper slide 28 by means of an upper bolt 56 and an upper sliding block 55, and in the plane of the lower slide 43 by means of a lower bolt 89 and a lower sliding block 88 with the lower slide 43. A holder 57 of a shaping tool 62 is supported rotatably in the bar 54 for reversible rolling by means of an axial bearing 58 and a radial bearing 57. The tool holder 57 is fixed to an elastic element 60, which is fixed to the lower cover 19 by means of a ring 61. The shaping tool 62 is fixed to the tool holder 57 by means of an elastic ring 64 and by means of a transverse bolt 63. The whole unit is fixed to the main body 20 of the arrangement by means of the upper cover 18.

The reversible relative rolling movement of the active surface 90 of the shaping tool along the shaped surface 91 (FIG. 7) is accomplished by means of the bar 54 for reversible relative rolling. The movement of the bar 54 for reversible relative rolling is generated by a reciprocating sliding movement of the upper slide 28 in the upper sliding guiding 27 and by a reciprocating sliding movement of the lower slide 43 in the lower sliding guiding 46. The upper slide 28 acts on the bar 54 for reversible relative rolling over the upper bolt 56 and the upper sliding block 55. The lower slide 43 acts on the bar 54 for reversible relative rolling similarly through the lower bolt 89 and the lower sliding block 88.

The reciprocating movement of the slide 28 is thereby accomplished by the movement of the guiding element 29 of the upper slide in the upper eccentric groove 70 of the rotating disc 69 for reversible relative rolling. Similarly the reciprocating movement of the lower side 43 is obtained by the movement of the guiding element 44 of the lower slide in the lower eccentric groove 71 of the rotating disc 69 for reversible relative rolling. The rotation of this disc 69 is in this case derived from the wheel 73 on the rear shaft 21. The bar 54 for reversible relative rolling is forced to perform a reversible movement in the plane of the upper slide 28 and in the plane of the lower slide 43, whereby the eccentricity E1 (FIG. 7) in the plane of the upper slide is at a certain ratio larger than the eccentricity E2 in the plane of the lower slide 43; the bar 54 for reversible relative rolling by means of rollers 52 supported on bolts 51 performs a motion along the rolling tracks 50 of the holder 49. These circumstances cause a relative rolling motion of the active surface 90 of the shaping tool 62 along the shaped surface 91 in its axial plane. The required turning of the plane of the reversible relative rolling with the axial plane of the shaped surface 91 is achieved by way of the central shaft 22.

By the selection of the ratio of rotating speeds of the central shaft 22 and the rear shaft 21, the character of the course of the curve 14 for relative rolling can be either that according to FIG. 5 or FIG. 6. In order to obtain a uniform relative rolling of all points of the active surface 90 of the shaping tool 62 along the shaped surface 91 and a uniform wear of the active surface 90, the shaping tool 62 is fixed against turning in its holder 57 by a transverse bolt 63 and the whole holder 57 is fixed to an elastic element 60, permitting a reciprocating movement but preventing any rotation of the holder 57 which is rotatably supported on the bar 54 for reversible relative rolling. To prevent any falling out, the shaping tool 62 is fixed by means of an elastic ring 64.

Figure 10:
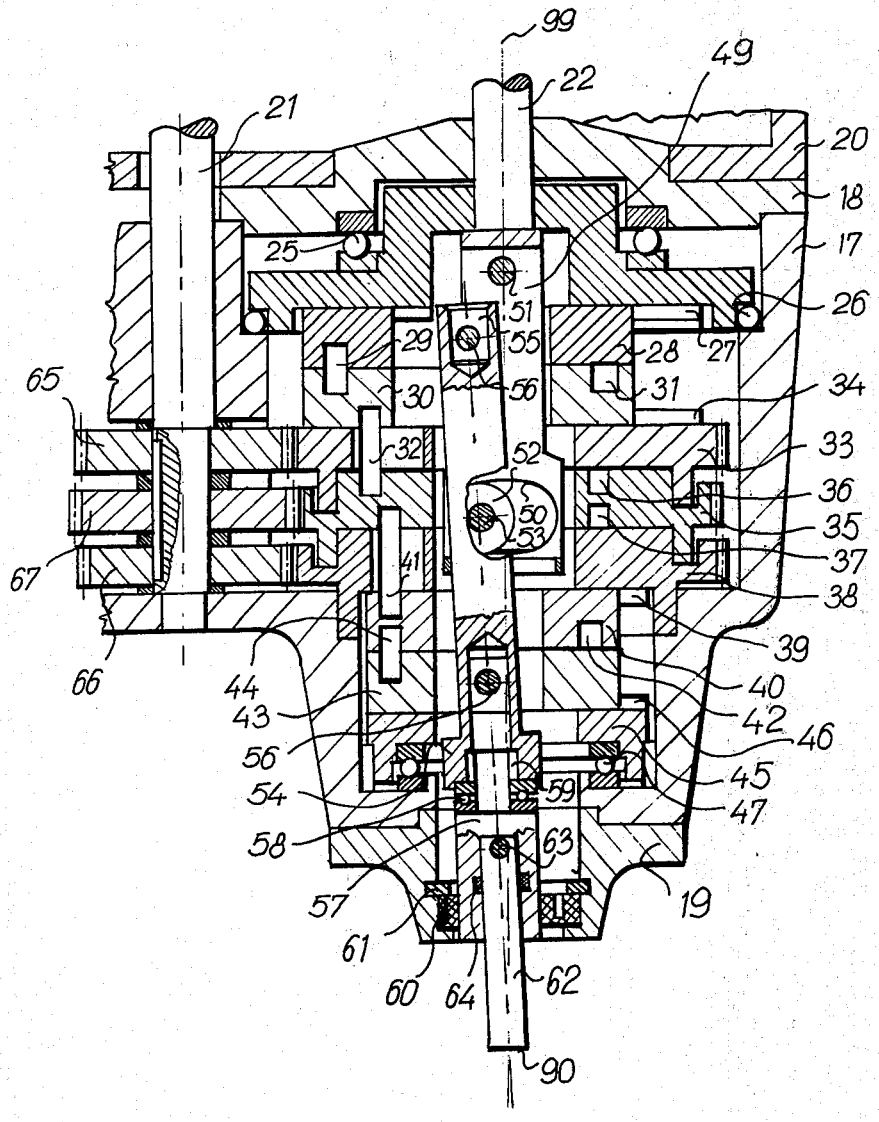
FIG. 10 shows another embodiment for shaping by reversible relative point rolling in a rotating axial plane of the shaped surface with a continuous change of amplitude of the reversible relative rolling, which has a constant ratio with the movement of the reversible relative rolling.

An arrangement with a continuous change of the amplitude of the reversible relative rolling is shown in FIG. 10, which differs from the solution according to FIG. 9 in that the disc 69 for reversible relative rolling is divided into an upper disc 33 and a lower disc 38 for reversible relative rolling. A disc 35 for changing the amplitude is inserted between the above-mentioned discs 33 and 38; disc 35 is provided on its upper surface with an upper eccentric groove 36 for changing the amplitude and on its lower surface with a lower groove 37 for changing the amplitude. An upper intermediate piece 30 is inserted between the upper slide 28 and the upper disc 33 for reversible relative rolling, said intermediate piece 30 being provided with a groove 31, and a lower intermediate piece 40 is inserted between the lower slide 43 and the lower disc 38 for reversible relative rolling, this lower intermediate piece being provided on its lower surface with a groove 42.

The upper disc 33 for reversible relative rolling is provided on its upper surface with an upper sliding guiding means 34 and the lower disc 38 for reversible relative rolling is on its lower surface provided with a lower sliding guiding means 39. The upper intermediate piece 30 is slidingly supported in the upper sliding guiding means 34 and the lower intermediate piece 40 is slidingly supported in the lower sliding guiding means 39. The upper intermediate piece 30 has on its lower side an upper guiding element 32, engaging in sliding fashion into the upper eccentric groove of the disc 36 for changing the amplitude. The lower intermediate piece 40 has on its upper side a lower guiding element 41 engaging in sliding fashion into the lower eccentric groove of the disc 36 for changing the amplitude. The lower intermediate piece 40 has on its upper side a lower guiding element 41 engaging in sliding fashion into the lower eccentric groove of the disc of the upper slide engages slidingly into the groove 31 of the upper intermediate piece, and the guiding element 44 of the lower slide engages slidingly into the groove 42 of the lower intermediate piece. Instead of the wheel 73 on the rear shaft, as shown in FIG. 9, there are fixed on the rear shaft 21 an upper driving wheel 65, a lower driving wheel 66, and a middle driving wheel 67.

The reciprocating sliding motion of the upper slide 28 is achieved by movement of the guiding element 29 of the upper slide in the groove 31 of the upper intermediate piece, which rotates together with the upper disc 33 for reversible relative rolling, whereby the eccentricity of the groove 31 of the upper intermediate piece with respect to the axis 99 of the shaping unit is changed by sliding the upper intermediate piece 30 along the upper sliding guiding means 34 of the upper disc 33 of reversible relative rolling generated by the shifting of the upper guiding element 32 within the upper eccentric groove 36 of the disc 36 for changing the amplitude. Similarly, the reciprocating sliding movement of the lower slide 43 is accomplished by movement of the guiding element 44 of the lower slide in the groove 42 of the lower intermediate piece, which rotate together with the lower disc 28 for reversible relative rolling, whereby the eccentricity of the groove 42 of the lower intermediate piece with respect to the axis 99 of the shaping unit is changed by sliding the lower intermediate piece 40 along the lower sliding guiding means 39 of the lower disc 38 for reversible relative rolling derived from the lower guiding element 41, sliding along the lower eccentric groove 37 of the disc 37 for changing the amplitude.

Synchronism of the reciprocating movement of the upper slide 28 and of the lower slide 43, the same as its planar motion, is secured by an equal transmission ratio of the upper driving wheel 65 with the upper disc 33 for reversible relative rolling and of the lower driving wheel 66 with the lower disc 38 for reversible relative rolling. The transmission ratio between the middle driving wheel 67 with the disc 35 for changing the amplitude is higher, and the disc 35 for changing the amplitude has therefore a higher rotating speed; in consequence thereof it continuously and systematically changes the amplitude of reversible relative rolling by shifting the upper intermediate piece 30 and the lower intermediate piece 40 and increasing or decreasing both the eccentricity of the groove 31 of the upper intermediate piece and the eccentricity of the groove 42 of the lower intermediate piece with respect to the axis 99 of the shaping unit.

Figure 11:
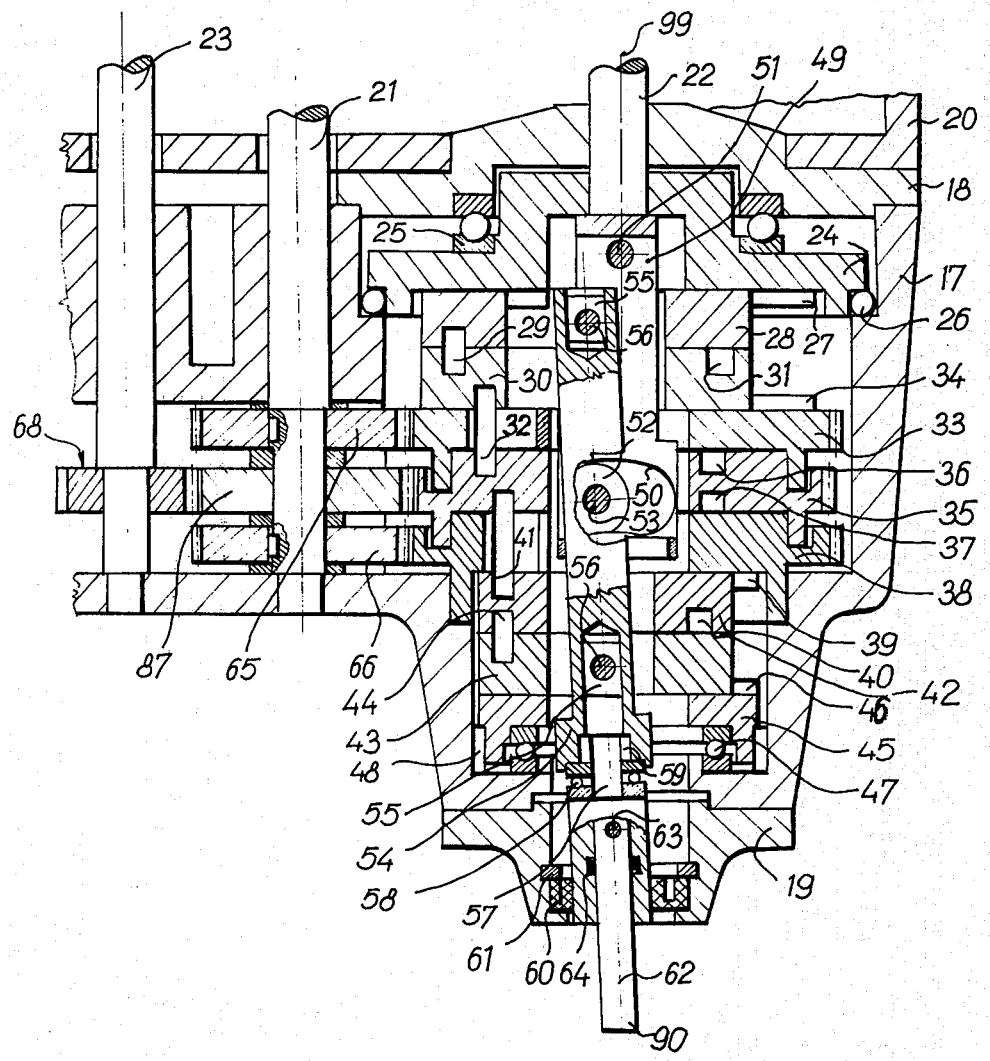
FIG. 11 shows an embodiment for shaping by reversible relative point rolling in a rotating axial plane of the shaped surface with a common change of amplitude of the reversible relative rolling, the drive being derived from an independent driving mechanism.

Another modification of the arrangement according to this invention enabling a common course of change of the amplitude is shown in FIG. 11. It differs from the arrangement with a continuous change of the magnitude of the amplitude, as shown in FIG. 10, in that it comprises instead of the driving wheel 67 fixed on the rear shaft 21, an intermediate wheel 87 rotatably supported on the rear shaft and in addition an independent driving mechanism 68 with a shaft 23 for changing the amplitude.

By means of the independent driving mechanism 68 and the intermediate wheel 87, it is possible to change the rotating speed of the disc 35 for changing the amplitude in any arbitrary manner and thus to obtain any chosen course of the change of the amplitude of the reversible relative rolling.

Figure 12:
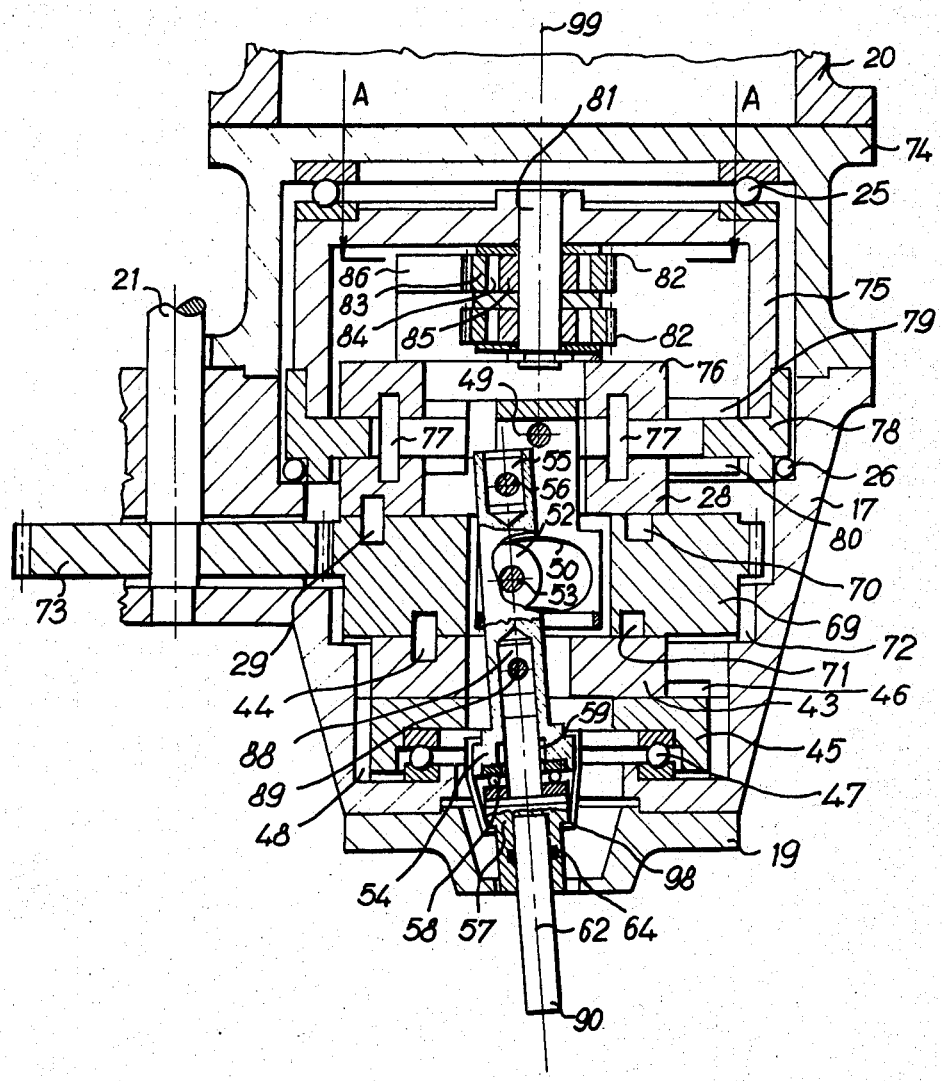
FIG. 12 shows an embodiment for shaping by reversible relative point rolling in a rotating axial plane of the shaped surface with constant amplitude of the reversible relative rolling in case the turning of the plane of the reversible relative rolling is derived from the movement of the reversible relative rolling.

An arrangement according to this invention shown in FIG. 12 with a dependent turning of the plane of the reversible relative rolling, the course of which is shown in FIG. 4, differs from the arrangement operating with a constant amplitude of the reversible relative rolling as shown in FIG. 9 in the following elements. Instead of the upper supporting disc 24, the arrangement has a two sided upper supporting disc 78 (see FIG. 12) having a lower sliding guiding means 80 and a sliding guiding means 79 of the upper slide at the upper surace. The upper slide 28 is slidably guided in the lower sliding guiding 80 of the two sided disc 80. An auxiliary slide 76 is slidably supported by the sliding guiding means 79. The upper slide 28 and the auxiliary slide 76 are connected by connecting elements 77. A further supporting disc 75 is situated above and firmly to the two sided upper supporting disc 78, which itself is rotatably supported by an upper axial bearing 25 in the elevated upper cover 74 by means of which the whole shaping unit is fixed to the main body 20 of the arrangement.

Figure 13:
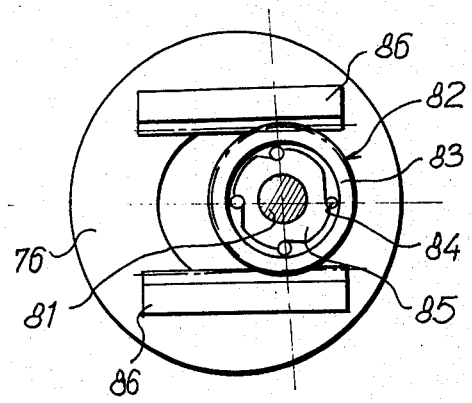
FIG. 13 is a horizontal section of part of the arrangement of FIG. 12, the section being taken along a plane indicated in FIG. 12 by the line A—A.

The two sided upper supporting disc 78 is rotatably supported by a combined bearing 26 of the upper disc in a manner similar in the embodiment shown in FIG. 9. Toothed brackets or racks 86 are firmly fixed to the auxiliary slide 76, which are more clearly shown in FIG. 13. One of the toothed brackets 86 is higher and meshes with the toothed rim 83 of the upper roller clutch 82. The second of the toothed brackets 86 is lower and meshes with the toothed rim 83 of the lower roller clutch 82. The roller clutches 82 comprise the already mentioned toothed rims 83, a take-along disc 85 of the clutch, and clutch rollers 84 (see FIG. 13). Both roller clutches 82, by means of their takealong discs 85, are fixed on a supporting bolt 81 firmly connected with the supporting disc 75, whereby the take-along discs 85 of the upper clutch is oriented in an opposite direction from the take-along discs 85 of the lower clutch.

Other differences with respect to the arrangement as shown in FIG. 9 are that the holder 57 of the shaping tools 62 is rotatably supported in the bar 54 for reversible relative rolling and is not fixed to the elastic element 60 as in FIG. 9, and the shaping tool 62 in the holder 57 is not secured against turning by a transverse bolt 63 as in FIG. 9. The holder 57 and the shaping tool 62 are therefore supported freely rotatably, and are secured solely against falling out. The holder 57 is axially secured by a clamp 98, and the shaping tool 62 is axially secured by an elastic ring 64.

The reciprocating movement of the auxiliary slide 76 along the sliding guiding 79 is derived from the reciprocating movement of the upper slide 28. The toothed brackets 86, in consequence of this movement, turn the toothed rims 83 of the roller clutches 82. As these roller clutches 82 are free running in one direction and transmit torque in the other direction, and as they are oriented in mutually opposite directions, the to-and-fro movement of the toothed brackets 86 with an alternate engagement causes a periodical turning of the supporting bolt 81 and thus also of the plane of the reversible relative rolling as indicated in FIG. 4. The uniform relative rolling of all points of the active surface 90 of the shaping tool 62 along the shpaed surface 91 (see FIG. 7) and a uniform wear of the active surface 90 require, in the case of the alternative of a free rotatable support of the holder 57 and of the shaping tool (FIG. 12) that the task of the elastic element 60 (FIG. 9) is taken over by the shaping resistance in the course of shaping by reversible relative rolling.

The object of this invention can also be used for other arrangements without deviating from the scope of this invention. Its application is, however, primarily in the shaping of closing heads of rivets of different shape and for different assembling operations such as connecting by extending, flashing, narrowing and the like. However, it can also be used for the manufacture of different objects by shaping.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims. What is claimed is:

1. Apparatus for shaping an element by relative rolling of an active surface of a shaping tool along a shaped surface of the element with simultaneous action of a shaping force in the direction of the axis of the shaped surface, comprising a body, an upper supporting disc and a lower supporting disc rotatably supported on this body around a common axis, an upper slide, a sliding guide on the lower surface of the upper supporting disc guiding the upper slide, a lower slide, a sliding guide on the upper surface of the lower supporting disc guiding the lower slide, a disc for reversible relative rolling provided between the upper and lower slide, eccentric grooves on the upper and lower surface of the disc for reversible relative rolling, means for engagement into the eccentric groove on the upper and lower surface respectively of the disc for reversible relative rolling provided on the upper and lower slides, respectively, means for imparting a rotating motion to the disc for reversible relative rolling, said upper and lower supporting discs, the upper and lower slide, and the disc for reversible relative rolling being provided with central openings, a bar for reversible relative rolling situated within said openings, an upper and lower transverse opening in said bar, upper and lower sliding blocks respectively slidingly guided in said openings, an upper bolt connecting the upper sliding block with the upper slide, a lower bolt connecting the lower sliding block with the lower slide, a supporting piece fixed to the upper supporting disc, rolling tracks provided in said supporting piece, roller bolts supporting rollers fixed to the bar for reversible relative rolling, said rollers being adapted for rolling along said rolling tracks in the supporting piece, means for imparting a turning movement around the common axis of both supporting discs to the supporting piece, and a tool holder with a shaping tool supported by the bar for reversible relative rolling.

2. Apparatus as in claim 1, wherein the tool holder of the shaping tool is rotatably supported by the bar for reversible relative rolling.

3. Apparatus as in claim 1, wherein the tool holder of the shaping tool is fixed to a stable elastic element and the shaping tool is secured in the tool holder against rotation and shifting.

4. An apparatus as in claim 1, wherein the disc for reversible relative rolling is divided into an upper disc for reversible relative rolling and a lower disc for reversible relative rolling, a disc for changing the amplitude inserted between said upper and lower discs, means for imparting a rotating movement at equal rotating speed to the upper and lower disc for reversible relative rolling, means for imparting a rotating movement at a different rotating speed to the disc for changing the amplitude, the disc for changing the amplitude being provided on both on its upper and lower sides with an upper and lower eccentric groove, an upper intermediate piece inserted between the upper slide and the upper disc for reversible relative rolling, the upper intermediate piece being provided on its upper surface with a groove, the upper slide being provided with guiding means for engagement into this groove, the upper intermediate piece being provided with a transverse sliding guiding means with respect to the upper disc for reversible relative rolling, the lower part of the upper intermediate piece being provided with upper guiding means engaging into the upper eccentric groove of the disc for changing the amplitude, a lower intermediate piece inserted between the lower slide and the lower disc for reversible relative rolling, the lower intermediate piece being provided on its lower surface with a groove, the lower slide being provided with guiding means for engagement into this groove, a transverse sliding guiding means being provided between the lower disc for reversible relative rolling and the upper part of the lower intermediate piece, and the upper part of the lower intermediate piece being provided with a lower guiding means for engagement into the lower eccentric groove of the disc for changing the amplitude.

5. An apparatus as in claim 4, wherein the apparatus is provided with independent driving means with an arbitrary adjustable transmission ratio for the drive of the disc for changing the amplitude.

6. An apparatus for shaping an element by relative rolling of an active surface of a shaping tool along a shaped surface of the element with simultaneous action of a shaping force in the direction of the axis of the shaped surface, comprising a body, a lower supporting disc rotatably supported on this body, a lower slide guided for transverse sliding on the lower supporting disc, a disc for reversible relative rolling situated above the lower slide, an upper slide situated above the disc for reversible relative rolling, the disc for reversible relative rolling being provided on both its upper and lower side with an eccentric groove, guiding means both on the upper and lower slide engaging into the respective groove on the disc for reversible relative rolling, a two sided upper supporting disc situated above the upper slide and transversely slidingly guiding the upper slide, an auxiliary slide situated above the two sided upper supporting disc transversely slidingly guided by the two sided upper supporting disc, connecting means connecting the upper slide with the auxiliary slide, a further supporting disc situated above and firmly connected to the upper supporting disc, an axial bolt fixed to this further supporting disc and supporting two oppositely oriented free wheel clutches, said free wheel clutches being provided with toothed rims, two oppositely situated toothed brackets provided on the auxiliary slide, the toothed rims meshing with the toothed brackets, means for imparting a rotating movement to the disc for reversible relative rolling, said lower supporting disc, lower slide, disc for reversible relative rolling, upper slide, two-sided upper supporting disc and auxiliary slide being provided with central openings, a bar for reversible relative rolling situated within said openings, an upper and lower transverse opening in said bar, an upper and lower sliding block respectively slidingly guided in said openings, an upper bolt connecting the upper sliding block with the upper slide, a lower bolt connecting the lower sliding block with the lower slide, a supporting piece fixed to the two-sided upper supporting disc, rolling tracks provided in said supporting piece, roller bolts, supporting rollers fixed to the bar for reversible relative rolling, said rollers being adapted for rolling along said rolling tracks in the supporting piece, and a tool holder with a shaping tool supported by the bar for reversible relative rolling.

7. In a method of shaping an element by relative rolling of an active surface of a shaping tool along a shaped surface of the element while a shaping force is applied to the shaped surface in the direction of its axis, the steps of cyclically and reciprocally translating the active surface of the shaping tool through a selectable distance across the axis of the shaped surface while maintaining a single point contact of the active surface with the shaped surface;

rotating the active surface about its axis during the reciprocal translation to vary the locus of said point contact in a loop-like pattern; and adjusting the distance of translation over successive cycles in accordance with a predetermined program.

8. A method of shaping an element by relative rolling of an active surface of a shaping tool along a shaped surface of the element with similtaneous action of a shaping force in the direction of the axis of the shaped surface, comprising relatively rolling the shaping tool reversibly with a point contact in an axial plane of the shaped surface, turning such plane of the relative point rolling around the axis of the shaped surface, and continuously varying the magnitude of the amplitude of this reversible relative rolling movement from zero to a maximum value and vice-versa within the shaping interval.

* * * * *